US008095021B2

(12) United States Patent
Mochizuki

(10) Patent No.: US 8,095,021 B2
(45) Date of Patent: Jan. 10, 2012

(54) IMAGE FORMING DEVICE DETERMINING REFILLED PRODUCT

(75) Inventor: Takafumi Mochizuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 375 days.

(21) Appl. No.: 12/184,917

(22) Filed: Aug. 1, 2008

(65) Prior Publication Data

US 2009/0034995 A1 Feb. 5, 2009

(30) Foreign Application Priority Data

Aug. 3, 2007 (JP) ..... 2007-203548

(51) Int. Cl.
*G03G 15/00* (2006.01)

(52) U.S. Cl. ..... 399/12; 399/27
(58) Field of Classification Search ..... 399/12, 399/27; 347/7
See application file for complete search history.

(56) References Cited

U.S. PATENT DOCUMENTS

2003/0184624 A1* 10/2003 Kinalski ..... 347/86
2004/0070642 A1* 4/2004 Murakami et al. ..... 347/19
2005/0163514 A1* 7/2005 Hwang ..... 399/8
2005/0219284 A1* 10/2005 Shima ..... 347/7
2006/0250425 A1* 11/2006 Nambudiri et al. ..... 347/7

FOREIGN PATENT DOCUMENTS

| | | |
|---|---|---|
| JP | 2002-244438 | 8/2002 |
| JP | 2002-331686 | 11/2002 |
| JP | 2004-354666 | 12/2004 |
| JP | 2005-326725 | 11/2005 |

* cited by examiner

*Primary Examiner* — David Gray
*Assistant Examiner* — G. M. Hyder
(74) *Attorney, Agent, or Firm* — DLA Piper LLP (US)

(57) ABSTRACT

An image forming device to which can be installed an image forming material cartridge which contains an image forming material, and which has a non-volatile memory from which data can be read and to which data can be written, includes a counter which approximately counts the image forming material usage amount of the image forming material cartridge, and generates an image forming material usage amount count; a state detector which detects a predetermined state in which it is inferred that the amount of the image forming material in the image forming material cartridge is low; a storage unit which stores amount of change information which specifies the amount of change of the image forming material usage amount count from the time point that the predetermined state was detected until the present in the non-volatile memory of the image forming material cartridge; and a determination unit which determines whether or not the image forming material cartridge is a refilled product, based upon the amount of change of the image forming material usage amount count and upon a first threshold value.

8 Claims, 5 Drawing Sheets

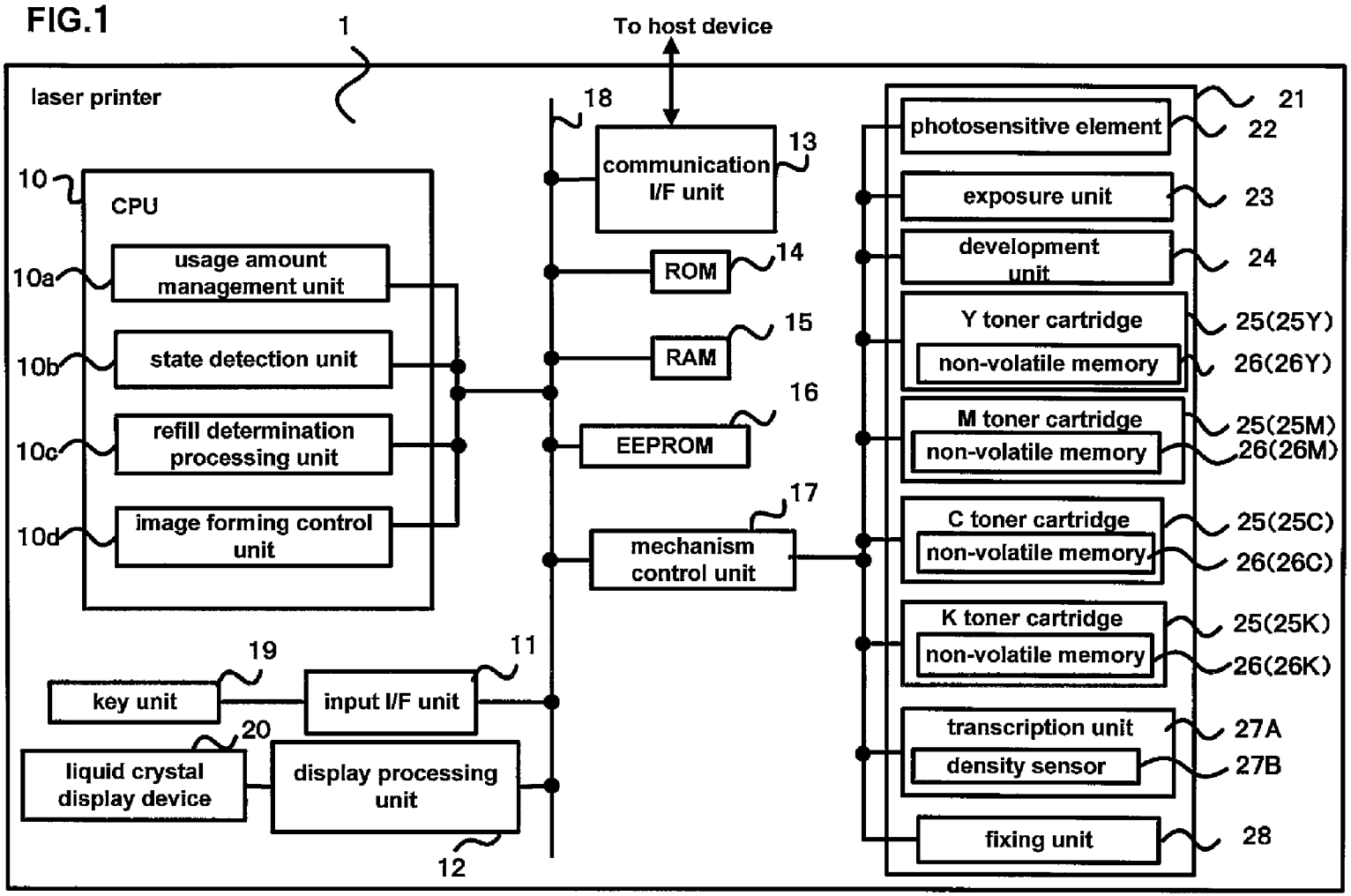
FIG.1
laser printer
1
To host device
18
communication I/F unit
13
ROM
14
RAM
15
EEPROM
16
mechanism control unit
17
photosensitive element
21
exposure unit
22
development unit
23
Y toner cartridge
24
non-volatile memory
25(25Y)
26(26Y)
M toner cartridge
non-volatile memory
25(25M)
26(26M)
C toner cartridge
non-volatile memory
25(25C)
26(26C)
K toner cartridge
non-volatile memory
25(25K)
26(26K)
transcription unit
27A
density sensor
27B
fixing unit
28
CPU
10
usage amount management unit
10a
state detection unit
10b
refill determination processing unit
10c
image forming control unit
10d
input I/F unit
11
display processing unit
12
key unit
19
liquid crystal display device
20

IMAGE FORMING DEVICE DETERMINING REFILLED PRODUCT

CROSS-REFERENCE TO PRIOR APPLICATION

This application relates to and claims the benefit of priority from Japanese Patent Application number 2007-203548, filed on Aug. 3, 2007 the entire disclosure of which is incorporated herein by reference.

BACKGROUND

1. Technical Field

The present invention relates to an image forming device in which can be installed an image forming material cartridge which contains an image forming material such as toner, ink, or the like, and which has a non-volatile memory which can be written and read; and, in particular, relates to a technique for determining upon refilling such an image forming material cartridge with image forming material.

2. Related Art

In the past, it has been possible to install a toner cartridge in which toner for forming images is contained into an image forming device which performs image forming such as printing or the like. And, when the toner which was contained in the toner cartridge has been used up, it becomes possible to perform further image forming by exchanging the cartridge for a new toner cartridge.

In recent years, sometimes a refilled product which is made by recharging (refilling) toner into a toner cartridge which has been used up has been installed in an image forming device and used.

Accordingly, if a refilled product is used, it is necessary to urge the user to take care about the existence of this type of possibility.

Due to this, for example, it has been practiced to keep a running total of a toner usage amount count which roughly indicates the actual toner usage amount, and, when this exceeds a predetermined threshold value, to determine that this is a refilled product, and to urge the user to take care. As such a toner usage amount count, a physical quantity is used which is considered to be strongly related to the amount of toner consumed (i.e. to the toner usage amount), for example the number of dots which have been printed, the rotational speed of a motor for supplying toner to a development unit, the period of time such a motor has been driven, or the like.

As a technique for detecting refilling, for example, a technique is known (refer to JP-A-2002-331686) of recording processing in which the amount of ink decreases, and, if the amount of ink has increased although the ink container has not been exchanged, issuing a warning to the effect that, it is not possible to guarantee normal printing, since the ink has been refilled.

However, with the invention described in JP-A-2002-331686, there is the problem that it is necessary to provide a structure for detecting the actual remaining amount of ink. For example, it is extremely difficult to detect the remaining amount of toner in a toner cartridge, so that it is extremely difficult to provide a structure for doing so.

On the other hand, if it is arranged to keep a running total of a toner usage amount count from the start of use, and to determine that the cartridge is a refilled product if this has exceeded a predetermined threshold value, then the following type of problem arises.

For example it has been considered to take, as the threshold value, a value which cannot normally be arrived at. However, since such a toner usage amount count is not the actual usage amount of the toner itself, but rather is something which roughly indicates the toner usage amount, such as a physical quantity like, as mentioned above, the number of dots which have been printed, the rotational speed of a motor for supplying toner to the development unit, the period of time such a motor has been driven, or the like. Accordingly there is a fear that the correspondence relationship between the toner usage amount count and the actual amount of toner consumption will be very much different, depending upon the circumstances of use by the user. In other words there is a fear that, depending upon the circumstances of user the actual amount of toner consumed may be greatly different, so that the remaining amount of toner may be greatly different, even though the toner usage amount count may be the same.

Due to this, even if the toner usage amount count is at a value of 150% of the toner usage amount count at which it is supposed that, with normal usage, the toner is used up, nevertheless, due to the circumstances of usage, it might be the case that some toner is left remaining. Accordingly, if a value of 150% of the toner usage amount count at which it is supposed that, with normal usage, the toner is used up, is taken as being the threshold value, then the possibility exists of mistakenly deciding that a toner cartridge which has not been refilled is a refilled product.

In order to prevent the occurrence of this type of mistaken decision, it is necessary to set the threshold value to be a large value, but, even if this is done it is difficult perfectly to prevent mistaken decisions, unless the threshold value is extremely large.

On the other hand, if the threshold value is set to be a larger value, then it becomes possible to suppress the occurrence of mistaken decisions to a comparatively large extent, but, since a considerable time period is required until the toner usage amount count arrives at the threshold value, accordingly, even if the subject cartridge is a refilled product, this considerable time period will elapse until it is determined that it is a refilled product, so that there is a fear that the message urging the user to take care will be undesirably delayed.

Moreover, in recent years, sometimes rental of a toner cartridge to the user is performed. In this case, in the rental contract for the toner cartridge, sometimes a clause is also incorporated, for example, specifying that refilling should not be performed. In this type of case, there is a requirement to prevent improper usage outside the scope of the rental contract; in other words there is a requirement to prevent usage in which this toner cartridge, which is a rental product, is refilled. Moreover, it may be considered to use both a rental product and a purchased product in parallel in the image forming device, and in this type of case as well, there is a requirement to prevent, in an appropriate manner, unauthorized use of the rental product.

SUMMARY

An advantage of some aspects of the invention is the provision of a technique which can determine, at an early stage, that an image forming material cartridge has been refilled. Moreover, another advantage of some aspects of the invention is the provision of a technique which can appropriately prevent unauthorized use of an image forming material cartridge which is rented.

In order to obtain the above advantages, according to a first aspect of the invention, an image forming device, to which can be installed an image forming material cartridge which contains an image forming material, and which has a non-volatile memory from which data can be read and to which data can be written; includes a counter which approximately counts the image forming material usage amount of the image forming material cartridge, and generates an image forming material usage amount count; a state detector which detects a predetermined state in which it is inferred that the amount of the image forming material in the image forming material cartridge is low; a storage unit which stores amount of change information which specifies the amount of change of the image forming material usage amount count from the time point that the predetermined state was detected until the present in the non-volatile memory of the image forming material cartridge; and a determination unit which determines whether or not the image forming material cartridge is a refilled product, based upon the amount of change of the image forming material usage amount count and upon a first threshold value.

According to this image forming device, since it is arranged to make the decision as to whether or not the subject cartridge is a refilled product by using the amount of change of the image forming material usage amount count subsequent to detection of the predetermined state, accordingly, with regard to the threshold value which is used for comparison, it is possible to reduce the amount of error which must be included in this threshold value, since it is sufficient to give consideration to error of the image forming material usage amount count corresponding to the state of usage from the time point at which the predetermined state is detected. Accordingly, if this image forming material cartridge is a refilled product, it becomes possible to determine that it is a refilled product at an earlier stage.

With this image forming device, it would also be acceptable to arrange for the amount of change information to include a cumulative image forming material usage amount count, counted by the counter from the start of usage of the image forming material cartridge, and a cumulative image forming material usage amount count when detected, which is the cumulative image forming material usage amount count at the time point that the predetermined state is detected; further to include a first judgement unit which obtains the amount of change of the image forming material usage amount count by subtracting the cumulative image forming material usage amount count when detected from the cumulative image forming material usage amount count, and judges whether or not the amount of change of the image forming material usage amount count is greater than the first threshold value; and for the determination unit to determine that the image forming material cartridge is a refilled product, if it has been determined by the first determination unit that the amount of change of the image forming material usage amount count is greater than the first threshold value. And, with this image forming device, it is possible to calculate the amount of change of the image forming material usage amount count subsequent to the detection of the predetermined state in an appropriate manner, and thus to determine upon whether or not the subject cartridge is a refilled product in an appropriate manner.

Moreover, with this image forming device, it would also be acceptable to arrange, when the predetermined state is detected for a second time, for the storage unit to update the cumulative image forming material usage amount count when detected to the cumulative image forming material usage amount count at the time point of this detection for a second time.

According to this image forming device, when the predetermined state is detected for a second time, it is possible to determine whether or not this cartridge is a refilled product in an appropriate manner, according to the amount of change of the image forming material usage amount count from this time point.

Moreover, according to this image forming device, it would also be acceptable, when the predetermined state is detected for a second time, for the first judgement unit to change the value of the first threshold value to a new value, and subsequently to determine whether or not the amount of change of the image forming material usage amount count is greater than the first threshold value after change.

According to this image forming device, since the first threshold value is changed to the new value at the time point that the predetermined change has been detected, accordingly it is possible to determine the value of the first threshold value in a more appropriate manner, so that it is possible to determine whether or not this cartridge is a refilled product at an earlier stage.

Furthermore, according to this image forming device, there may be further included a second judgement unit which judges whether or not the cumulative image forming material usage amount count from the start of usage of the image forming material cartridge is greater than a second threshold value; and it may be arranged for the determination unit to determine that the image forming material cartridge is a refilled product, if it has been determined by the second judgement unit that the cumulative image forming material usage amount count is greater than the second threshold value.

According to this image forming device, if, for example, refilling of the image forming material cartridge has been performed in the state in which the predetermined state is not detected, then it is possible to make the determination that this cartridge is a refilled product in an appropriate manner.

Moreover, with this image forming device, it may be arranged for refill desirability data which shows whether or not refilling of the image forming material cartridge is permitted to be stored in the non-volatile memory, and there may be further included: a refill desirability judgement unit which, if it has been determined that the image forming material cartridge is a refilled product, judges whether or not refilling of the image forming material cartridge is permitted, based upon the refill desirability data in the non-volatile memory thereof; and an image forming possibility control unit which, if it has been determined that refilling of the image forming material cartridge is not permitted, makes image forming with the image forming material in the image forming material cartridge impossible.

According to this image forming device, it is possible, in an appropriate manner, to make it impossible to form an image with an image forming material cartridge for which refilling is not permitted. Due to this it is possible to prevent, in an appropriate manner, for example, improper usage of an image forming material cartridge which is the subject of a rental contract according to which refilling is not permitted.

And, in order to obtain the above advantages, according to a second aspect of the invention, an image forming device is one to which can be installed an image forming material cartridge which contains an image forming material, and which has a non-volatile memory from which data can be read and to which data can be written, wherein the non-volatile memory stores refill desirability data which shows whether or not refilling of the image forming material cartridge is permitted; a refill desirability judgement unit which, if it has been determined that the image forming material cartridge is a refilled product, judges whether or not refilling of the image forming material cartridge is permitted, based upon the refill desirability data in the non-volatile memory thereof; and an image forming possibility controler unit which, if it has been determined that refilling of the image forming material cartridge is not permitted, makes image forming with the image forming material in the image forming material cartridge impossible.

And, according to this image forming device, it is possible, in an appropriate manner, to make it impossible to form an image with an image forming material cartridge for which refilling is not permitted. Due to this it is possible to prevent, in an appropriate manner, for example, improper usage of an image forming material cartridge which is the subject of a rental contract according to which refilling is not permitted.

And, in order to obtain the above advantages, according to a third aspect of the invention, a refill determination method for an image forming device to which can be installed an image forming material cartridge which contains an image forming material, and which includes a non-volatile memory from which data can be read and to which data can be written, includes: a counter of the image forming device approximately counting the image forming material usage amount of the image forming material cartridge, and generating an image forming material usage amount count; a state detector of the image forming device detecting a predetermined state in which it is inferred that the amount of the image forming material in the image forming material cartridge is low; a storage unit of the image forming device storing amount of change information which specifies the amount of change of the image forming material usage amount count from the time point that the predetermined state was detected until the present in the non-volatile memory of the image forming material cartridge; and a determination unit of the image forming device determining whether or not the image forming material cartridge is a refilled product, based upon the amount of change of the image forming material usage amount count and upon a first threshold value.

According to this refill determination method, since it is arranged to make the determination as to whether or not the subject cartridge is a refilled product by using the amount of change of the image forming material usage amount count from the time point that the predetermined state is detected, accordingly, with regard to the threshold value which is used for comparison, it is possible to reduce the amount of error which must be included in this threshold value, since it is sufficient to give consideration to error of the image forming material usage amount count corresponding to the state of usage from the time point at which the predetermined state is detected. Accordingly, if this image forming material cartridge is a refilled product, it becomes possible to determine that it is a refilled product at an earlier stage.

BRIEF DESCRIPTION OF THE DRAWINGS

FIG. 1 is a functional structural diagram of a laser printer according to an embodiment of the invention;

DESCRIPTION OF EXEMPLARY EMBODIMENTS

Figure 2:
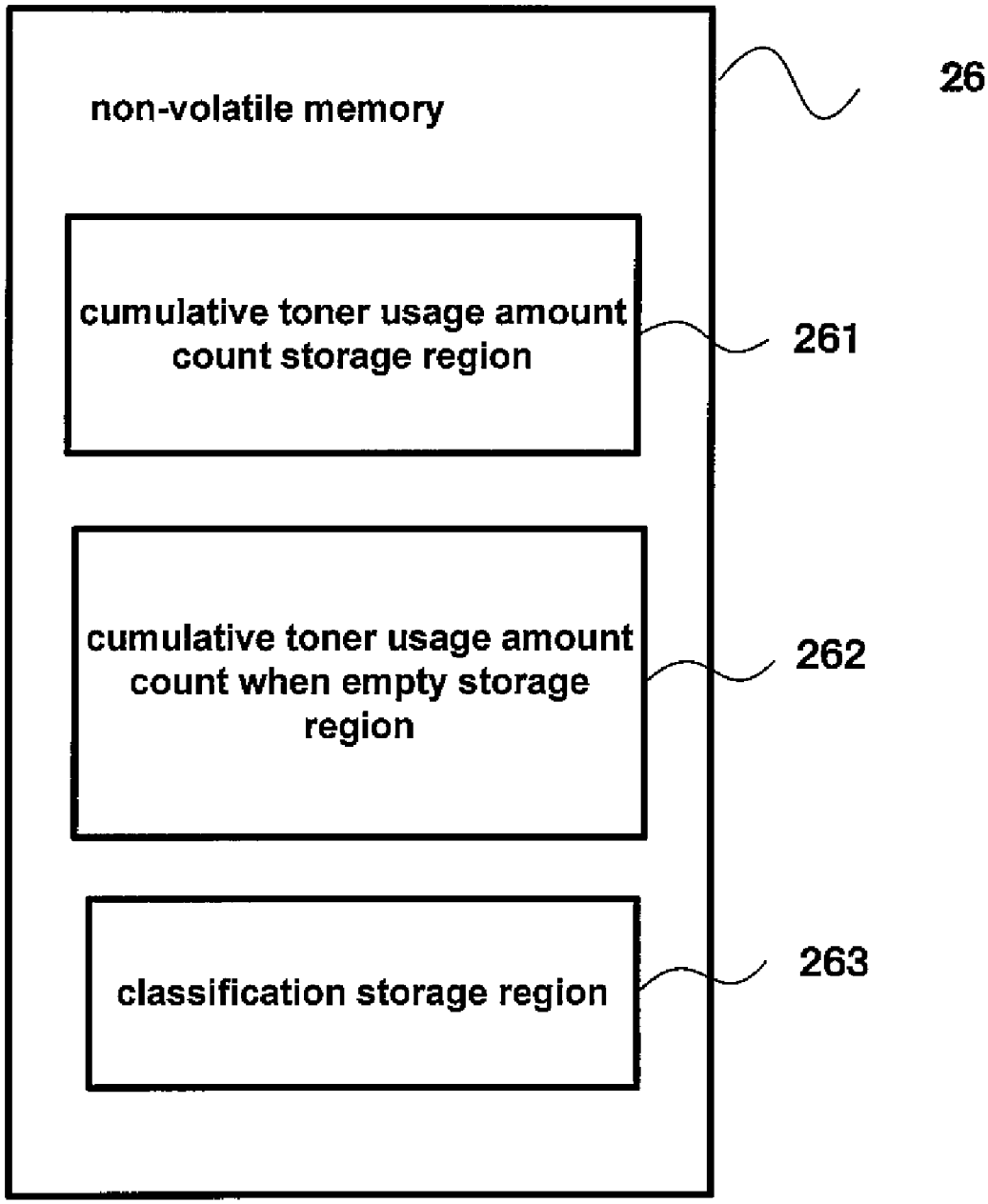
FIG. 2 is a figure showing an example of the structure of a non-volatile memory according to an embodiment of the invention.

Embodiments of the invention will now be explained with reference to the drawings. It should be understood that the embodiments explained below are not limitative of the invention as defined by the scope of the Claims; and, moreover, a combination of all of the features explained in the embodiments is not essential to the means for solution of the invention.

First a laser printer will be explained, as one example of an image forming device according to an embodiment of the invention.

FIG. 1 is a functional structural diagram of a laser printer according to an embodiment of the invention.

In the laser printer 1, a CPU (Central Processing Unit) 10, an input interface unit (input I/F unit) 11, a display processing unit 12, a communication interface unit (communication I/F unit) 13, a ROM (Read Only Memory) 14, a RAM (Random Access Memory) 15, an EEPROM (Electrically Erasable Programmable Read-Only Memory) 16, and a mechanism control unit 17 are connected together via a bus 18.

A key unit 19 is connected to the input I/F unit 11. The input I/F unit 11 outputs data corresponding to signals from the key unit 19 to the CPU 10. The key unit 19 includes a start button, a stop button, a tenkey pad and so on which are provided to a enclosure not shown in the figures of the laser printer 1, and outputs to the input I/F unit 11 signals corresponding to those ones of these buttons or keys which are depressed.

The display processing unit 12 includes, for example, a VRAM (Video Random Access Memory), and, according to control by the CPU 10, generates various types of image data, and provides display output to a liquid crystal display device (LCD) 20.

The communication I/F unit 13 can be connected to an external device (a host device or the like) via a network, and, via the network, performs mediation of data exchange with the external device.

The ROM 14 stores a boot program and processing programs of various types and so on.

The RAM 15 is utilized as a region for storage of programs or data, or as a working area in which data used for processing by the CPU 10 is stored.

The EEPROM 16 is a non-volatile memory which can be rewritten, and stores various types of information which are required to be stored even when the power supply to the laser printer 1 is not turned on.

Based upon control by the CPU 10, the mechanism control unit 17 controls the operation of an image forming unit 21. The image forming unit 21 comprises: a photosensitive element 22; an exposure unit 23; a development unit 24; a yellow (Y) toner cartridge 25Y, a magenta (M) toner cartridge 25M, a cyan (C) toner cartridge 25C, and a black (K) toner cartridge 25K which are examples of image forming material cartridges; a transcription unit 27A; and a fixing unit 28.

The photosensitive element 22 comprises a photosensitive body for forming a toner image.

The exposure unit 23 forms a latent electrostatic image for making a toner image upon the photosensitive body of the photosensitive element 22.

The development unit 24 develops this latent electrostatic image formed upon the photosensitive body using, as one example of image forming material, the toner contained in the toner cartridges 25 of the various colors (25Y, 25M, 25C, and 25K).

Each of the toner 25 (25Y, 25M, 25C, and 25K) contains in its interior toner of the respectively corresponding color. Furthermore, each of these toner cartridges 25 has a non-volatile memory 26 (26Y, 26M, 26C, and 26K) for storing various types of data relating to the respective toner cartridge. These non-volatile memories 26 may, for example, be EEPROMs.

FIG. 2 is a figure showing an example of the structure of a non-volatile memory according to an embodiment of the invention.

It should be understood that, since the structure of each of the non-volatile memories 26Y, 26M, 26C, and 26K is the same, the explanation will refer to all of them by the generic term "non-volatile memory 26".

Each of these non-volatile memories 26 has a cumulative toner usage amount count storage region 261, a cumulative toner usage amount count when empty storage region 262, and a classification storage region 263.

A cumulative count of the toner usage amount for the toner cartridge 25 (25Y, 25M, 25C, or 25K) to which this non-volatile memory 26 is provided is stored in the cumulative toner usage amount storage region 261. Here, a count which shows the toner usage amount schematically may be used as the toner usage amount count; for example, the number of dots which have been printed with toner of the corresponding color, the rotational speed of a motor for supplying toner to the development unit 24, or the time period over which the motor has been driven may be used.

In the cumulative toner usage amount count when empty storage region 262, there is stored a cumulative toner usage amount count when the empty state is detected (cumulative toner usage amount count when empty: cumulative image forming material usage amount count when the empty state is detected), which is assumed when the toner in the corresponding toner cartridge becomes low. It should be understood that, when the empty state is not detected, an initial value is stored here, for example "0". Here, by subtracting the cumulative toner usage amount count when empty from the cumulative toner usage amount count, it is possible to obtain the amount of change of the toner usage amount count from when empty; the cumulative toner usage amount count and cumulative toner usage amount count when empty exemplify amount of change information.

In the classification storage region 263, there is stored data (refill desirability data) which shows whether or not the corresponding toner cartridge 25 is classified as one for which refilling is permitted. In this embodiment, if this is a toner cartridge 25 for which refilling is not permitted according to its rental contract, then data (for example "1") which shows that this cartridge is classified as one for which refilling is not permitted is stored here, while if, for example, this is a toner cartridge 25 which has been sold outright, then data (for example "0") which shows that this cartridge is classified as one for which refilling is permitted is stored here.

Returning to the explanation of FIG. 1, the transcription unit 27A transcribes a toner image which has been formed upon the photosensitive body onto an intermediate transcription medium within itself, and then transcribes the toner image on this intermediate transcription medium from the intermediate transcription medium onto a sheet of blank paper (i.e. onto paper stock). In this embodiment, the transcription unit 27A comprises a density sensor 27B which detects the toner density of the toner image which has been formed upon the intermediate transcription medium.

The fixing unit 28 then fixes the toner image upon the paper stock by applying heat and pressure to the piece of blank paper stock upon which the toner image has been transcribed.

The CPU 10 controls the operation of the various units 10 through 17. Furthermore, by reading out into the RAM 15 and executing programs which are stored in the ROM 14, the CPU 10 performs various types of processing which constitute: a usage amount management unit 10*a* as one example of a counter and a storage unit; a state detection unit 10*b* as one example of a state detector means; a refill determination processing unit 10*c* as one example of a first judgement unit, a second judgement unit, a determination unit, and a refill desirability judgement unit; and an image forming control unit 10*d* as one example of an image forming possibility control unit.

The usage amount management unit 10*a* acquires, via the mechanism control unit 17, the cumulative toner usage amount counts from the toner cartridges 25 (25Y, 25M, 25C, and 25K), and, if operations which consume toner have taken place, such as printing or image adjustment or the like, adds toner usage amount counts corresponding to the toner amounts consumed to the corresponding cumulative toner usage amount counts, and stores the results in the non-volatile memories 26 (26Y, 26M, 26C, and 26K) of the corresponding toner cartridges 25 (25Y, 25M, 25C, and 25K), via the mechanism control unit 17. Moreover, if a notification has been received from the state detection unit 10*b* that a toner cartridge 25 is in the empty state, then the usage amount management unit 10*a* acquires the cumulative toner usage amount count of the corresponding toner cartridge 25 from the cumulative toner usage amount count storage region 261 of the non-volatile memory of the toner cartridge 25, and stores this cumulative toner usage amount count in the cumulative toner usage amount count when empty storage region 262 of the non-volatile memory 26.

The state detection unit 10*b* controls the mechanism control unit 17 to create a toner image of a predetermined pattern upon the intermediate transcription medium of the transcription unit 27A, and detects the occurrence of the empty state of each of the toner cartridges 25 (25Y, 25M, 25C, 25K) of the various colors by acquiring the toner density of that toner image from the density sensor 27B. In this embodiment, the state detection unit 10*b* is adapted to estimate that the toner in the toner cartridge of the corresponding toner is low and thus to detect that the empty state has occurred, if the toner density of the toner image which has been detected by the density sensor 27 is less than or equal to a predetermined density. If the empty state has been detected, along with notifying information which specifies that this toner cartridge 25 is in the empty state to the usage amount management unit 10*a*, the state detection unit 10*b* displays upon the liquid crystal display device 20 a notification to the effect that the corresponding toner cartridge 25 has reached the end of its life. Due to this, the user is able to ascertain whether or not any of the toner cartridges 25 has reached the end of its life.

The refill determination processing unit 10*c* judges, for a toner cartridge 25 for which the empty state has been detected, whether or not the amount of change of the toner usage amount count after the empty state has been detected exceeds a first threshold value, and determines that the cartridge is refilled goods if this amount of change does exceed the first threshold value. Here, the maximum toner usage amount count from when the empty state is detected until the toner is used up which can be hypothesized may be taken as being the first threshold value; or, for example, it would also be acceptable to take a value of 10% of the cumulative toner usage amount count which is hypothesized when a new production toner cartridge 25 has been used up. In this manner, with this embodiment, it is arranged to determine whether or not a cartridge is a refilled product, by comparing the amount of change of the toner usage amount count after the empty state has been detected, with the threshold value. By doing this, the error range which includes in the threshold value can be the error range which is hypothesized after the empty state has been detected. Therefore, for example, as compared to the case of comparing together the cumulative toner usage amount count from the time point that the new production cartridge is loaded and a threshold value, it is possible greatly to decrease the error range which must be included in the threshold value. Due to this, it becomes possible to determine that the subject cartridge is a refilled product at an early stage, as compared to the case of comparing together the cumulative toner usage amount count from the time point that the new production cartridge is loaded and a threshold value. It should be understood that it would also be acceptable to arrange to store the value of the first threshold value in a predetermined region in the non-volatile memory 26 of the toner cartridge, or to arrange to store it in the EEPROM 16 of the laser printer.

Furthermore, the refill determination processing unit 10*c* judges, for a subject toner cartridge 25 with which the empty state is not detected, whether or not the cumulative toner usage amount count exceeds a second threshold value, and determines that this cartridge is a refilled product if the count does exceed the second threshold value. Here it would be acceptable, for example, to arrange to take, as the second threshold value, a value of 200% of the cumulative toner usage amount count which is hypothesized when the toner in a new production toner cartridge 25 is used up. It should be understood that it would also be acceptable to arrange to store the value of the second threshold value in a predetermined region in the non-volatile memory 26 of the toner cartridge, or to arrange to store it in the EEPROM 16 of the laser printer.

Moreover, if it has been determined that the subject cartridge is a refilled product, then the refill determination processing unit 10*c* determines whether or not refilling of this toner cartridge 25 is forbidden, and on the one hand, if refilling is forbidden, issues a notification to the image forming unit to prohibit image forming using this toner cartridge 25, while on the other hand, if refilling of this cartridge is not forbidden, then it displays a message upon the liquid crystal display device 20 to the effect that a refilled product is being used.

And the image forming control unit 10*d* controls the image forming unit 21 via the mechanism control unit 17, and creates an image upon the image forming medium according to printing data which it has received via the communication I/F unit 13. Moreover the image forming control unit 10*d* is adapted not to perform image forming using the corresponding toner cartridge 25, if it has received a notification from the refill determination processing unit 10*c* to the effect that image forming is prohibited.

Next, the operation during processing of this laser printer 1 according to an embodiment of the invention will be explained.

Figure 3:
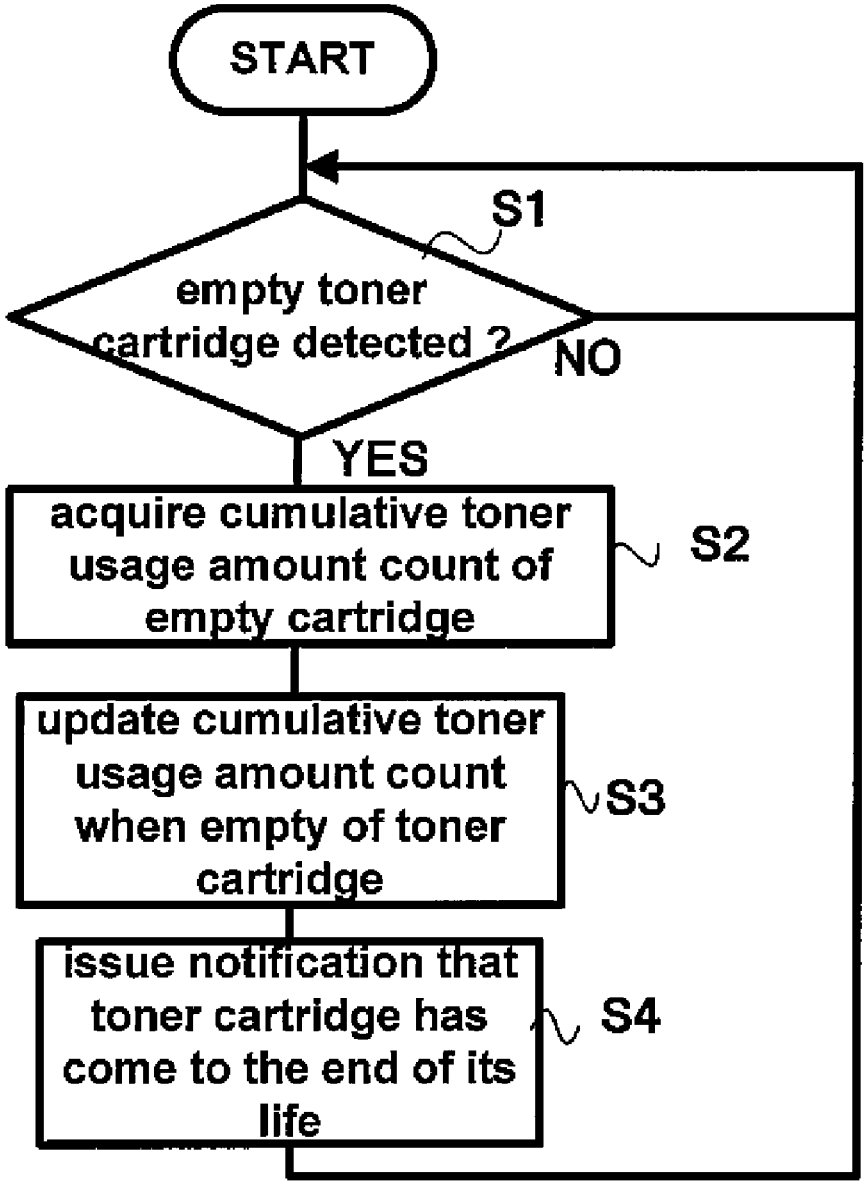
FIG. 3 is a flow chart showing the flow of toner cartridge management processing according to an embodiment of the invention.

FIG. 3 is a flow chart showing the flow of toner cartridge management processing according to an embodiment of the invention.

First, each time a predetermined timing arrives, the state detection unit 10*b* controls the image forming unit 21 via the mechanism control unit 17 to create a toner image of a predetermined pattern upon the intermediate transcription medium of the transcription unit 27A, acquires the toner density of this toner image from the density sensor 27B, and tries to detect the occurrence of the empty state for each of the toner cartridges 25 (25Y, 25M, 25C, and 25K) of the various colors (step S1). If the result is that the occurrence of the empty state is not detected (NO in the step S1), then the step S1 is executed again.

On the other hand, if the occurrence of the empty state has been detected for any one of the toner cartridges 25 (YES in the step S1), then the state detection unit 10*b* notifies information specifying the toner cartridge 25 which is in the empty state to the usage amount management unit 10*a*.

Upon receipt of this notification, the usage amount management unit 10*a* acquires the cumulative toner usage amount count of the corresponding toner cartridge 25 from the cumulative toner usage amount count storage region 261 of the non-volatile memory 26 of that toner cartridge 25 (step S2), and stores this cumulative toner usage amount count in the cumulative toner usage amount count when empty storage region 262 of the non-volatile memory 26 (step S3).

Next, the state detection unit 10*b* displays upon the liquid crystal display device 20 a notification to the effect that the toner cartridge for which the empty state has been detected has come to the end of its life (step S4), and then the sequence of processing steps from the step S1 is executed again.

By this processing, when the empty state of a toner cartridge 25 has been detected, the cumulative toner usage amount count when the empty state was detected comes to be stored in the non-volatile memory of that toner cartridge 25.

Here, for example, by taking out a toner cartridge 25 for which the empty state has been detected from the laser printer 1 and shaking it, the density of the toner may be revived, so that it becomes possible to use it for some more pages, indeed perhaps for several tens of pages more. By contrast, when this processing is performed, after the toner density has been revived, when for a second time the empty state is detected (YES in the step S1), in the step S3, the cumulative toner usage amount count at the time point that the subsequent empty state was detected comes to be stored in the cumulative toner usage amount count when empty storage region 262 of its non-volatile memory 26. Accordingly, when the empty state is detected a plurality of times for the same toner cartridge, the cumulative toner usage amount count at the time point that the final empty state was detected comes to be stored in the cumulative toner usage amount count when empty storage region 262 of its non-volatile memory 26.

Figure 4:
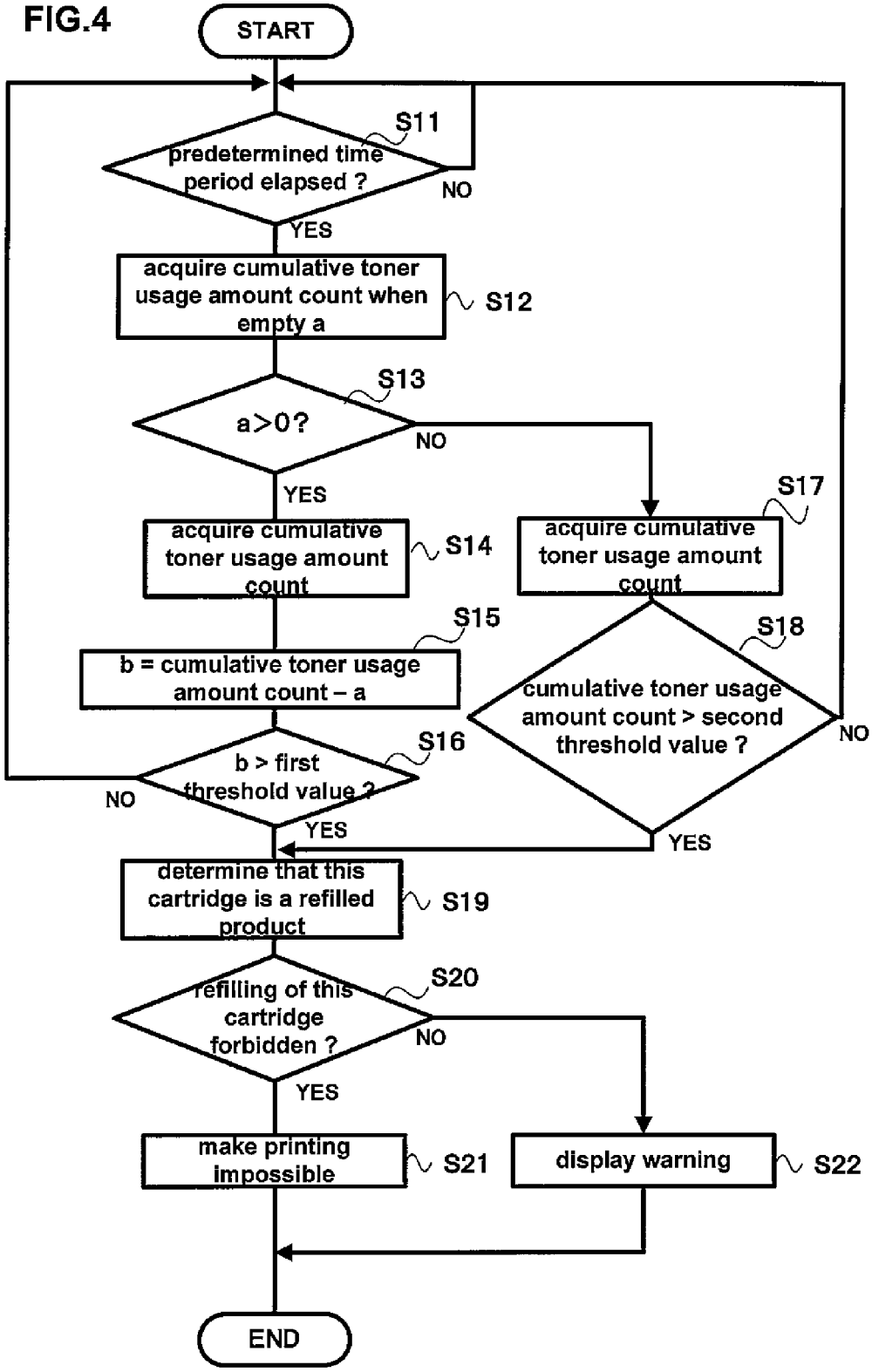
FIG. 4 is a flow chart showing the flow of processing for dealing with the question of refilling, according to an embodiment of the invention.

FIG. 4 is a flow chart showing the flow of processing for dealing with the question of refilling, according to an embodiment of the invention.

This processing corresponding to refilling is executed by taking each toner cartridge 25 of the laser printer 1 as the subject for processing.

First, the refill determination processing unit 10*c* determines whether or not a predetermined time period has elapsed (step S11), and if it has determined that the predetermined time period has not elapsed (NO in the step S11), then the execution of the step S11 is repeated.

On the other hand, if it is determined that the predetermined time period has elapsed (YES in the step S11), then the refill determination processing unit 10*c* acquires the cumulative toner usage amount count when empty a from the non-volatile memory 26 of the toner cartridge 25 which is the subject of processing, and judges whether or not the cumulative toner usage amount count when empty a is greater than 0 (step S13).

If the result is that the cumulative toner usage amount count when empty a is greater than 0 (YES in the step S13), then, since this means that the empty state has already been detected, the refill determination processing unit 10*c* acquires the cumulative toner usage amount count from the non-volatile memory 26 of the toner cartridge 25 which is the subject of processing (step S14), and, by subtracting the cumulative toner usage amount count when empty a from the cumulative toner usage amount count, calculates the amount of change b of the toner usage amount count from the time point that the empty state was detected until the present (step S15).

Next, the refill determination processing unit 10*c* judges whether or not the amount of change b of the toner usage amount count after the empty state was detected exceeds a first threshold value (step S16).

If, as a result, it is judged that the amount of change b of the toner usage amount count after the empty state was detected is not greater than the first threshold value (NO in the step S16), then, since it is not possible to determine that this cartridge is a refilled product, the determination processing unit 10*c* returns to the processing from the step S11. On the other hand, if it is judged that the amount of change b of the toner usage amount count after the empty state was detected is greater than the first threshold value (YES in the step S16) then, since this means that this cartridge is a refilled product, accordingly the refill determination processing unit 10*c* determines that the toner cartridge 25 which is the subject of processing is a refilled product (step S19).

On the other hand, if in the step S13 it has been judged that the cumulative toner usage amount count a when empty is not greater than 0 (in this example, is 0) (NO in the step S13), then, since this means that the empty state is not detected, accordingly the refill determination processing unit 10*c* acquires the cumulative toner usage amount count from the non-volatile memory 26 of the toner cartridge 25 which is the subject of processing (step S17), and determines whether or not the cumulative toner usage about count is greater than a second threshold value (step S18).

If, as a result, it has been judged that the cumulative toner usage amount count is not greater than the second threshold value (NO in the step S18), then, since it is not possible to determine that this cartridge is a refilled product, accordingly the refill determination processing unit 10*c* returns to the processing from the step S11. On the other hand, if it has been judged that the cumulative toner usage amount count is greater than the second threshold value (YES in the step S18), then, since this means that this is a refilled product which has been refilled before the empty state was detected, accordingly the refill determination processing unit 10*c* determines that the toner cartridge 25 which is the subject of processing is a refilled product (step S19).

If in the step S19 the refill determination processing unit 10*c* has determined that the toner cartridge 25 which is the subject of processing is a refilled product, then it determines whether or not refilling of this toner cartridge 25 is forbidden, based upon the refill desirability data which is stored in the classification storage region 263 of the non-volatile memory 26 of the toner cartridge 25 (step S20). If it has been judged that refilling is forbidden (YES in the step S20), then the refill determination processing unit 10*c* issues a notification to the image forming control unit 10*d* to the effect that image forming using the toner in this toner cartridge 25 is prohibited. Upon receipt of this notification, the image forming control unit 10*d* is made not to perform image forming using the corresponding toner cartridge 25, in other words it is made impossible to perform printing (step S21). Due to this, if for example a toner cartridge 25 which is the subject of a rental contract in which refilling is forbidden has in fact been refilled, then it is possible to prevent unauthorized use thereof contrary to the rental contract, in an appropriate manner.

On the other hand, if it has been determined that refilling of the toner cartridge 25 is not forbidden, then the refill determination processing unit 10*c* displays a warning on the liquid crystal display device 20 to the effect that a refilled product is being used (step S22). Due to this, it is possible to provide a warning to the user at an early stage that a refilled product is being used.

Next, a concrete example of the operation of this laser printer 1 will be explained.

Figure 5:
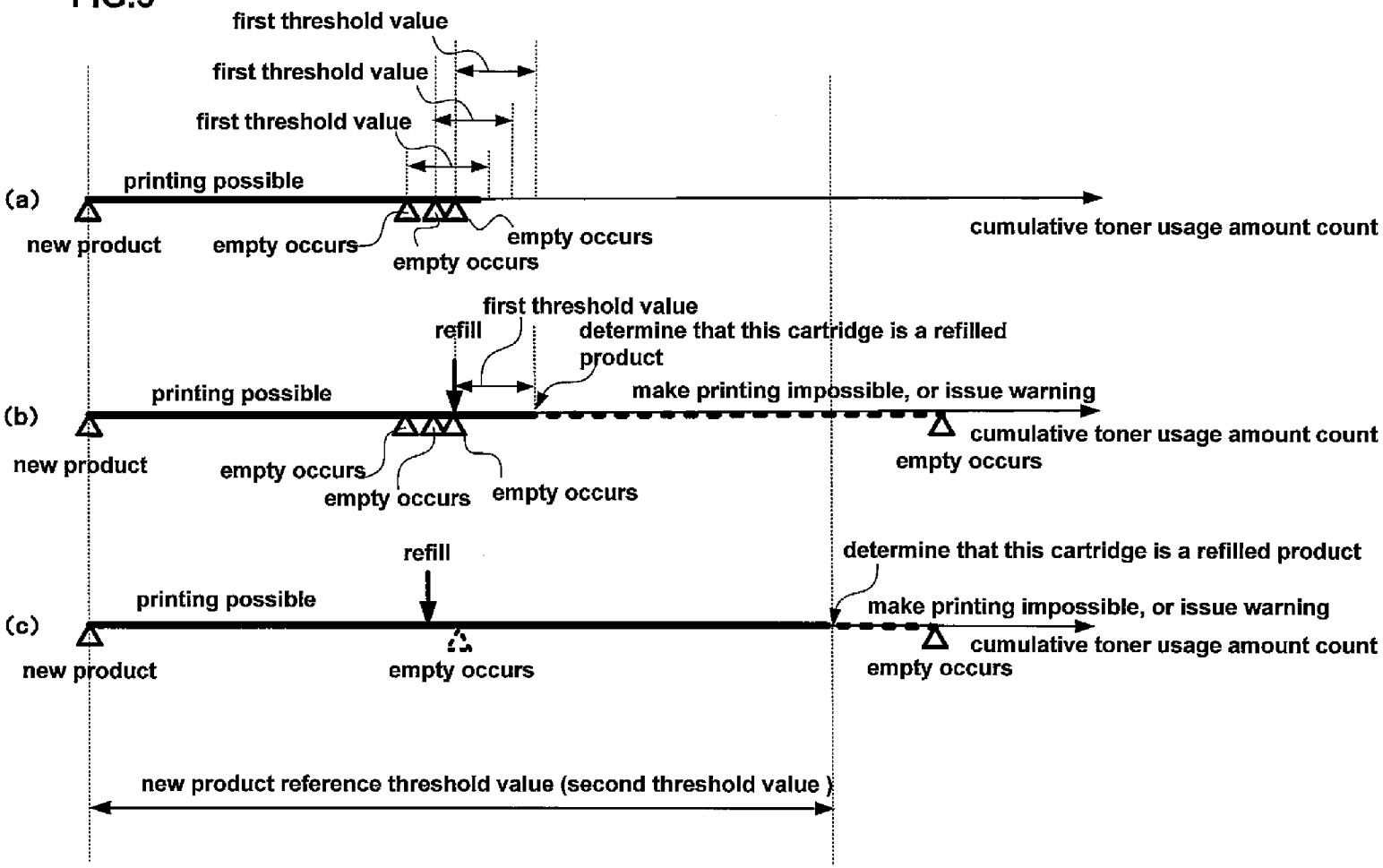
FIG. 5 is a figure for explanation of a concrete example of the operation of a laser printer according to an embodiment of the invention.

FIG. 5 is a figure for explanation of a concrete example of the operation of a laser printer according to an embodiment of the invention.

As shown with a line (a) in FIG. 5, when a new production toner cartridge 25 is being used, the cumulative toner usage amount count increases according to the usage of toner, and then a first empty state comes to be detected. At this time point, due to the step S3 shown in FIG. 3, the cumulative toner usage amount count when the first empty state is detected is stored in the cumulative toner usage amount count when empty storage region 262 of the non-volatile memory 26 of this toner cartridge 25.

Subsequently, in the step S16 shown in FIG. 4, a judgement comes to be made as to whether or not the amount of change of the toner usage amount count from when the first empty state was detected is greater than the first threshold value.

In this case, when the toner cartridge 25 is installed in the laser printer 1 for a second time after having been removed from the laser printer 1 and shaken, sometimes it happens that it becomes possible to perform further printing using this toner cartridge 25, but, in this case, the toner usage amount count which increases thereafter is limited, and the empty state comes to be detected a second time before the first threshold value is reached. It should be understood that, even if the same procedure is repeated a plurality of times, in the end it is certain that the empty state will be arrived at before the first threshold value is reached. It should be understood that, in this embodiment, due to the step S3 shown in FIG. 3, the cumulative toner usage amount count when the empty state was detected the last time comes to be stored in the cumulative toner usage amount count when empty storage region 262 of the non-volatile memory 26 of the toner cartridge 25; and, in the step S16 of FIG. 4, a judgement comes to be made as to whether or not the amount of change of the toner usage amount count from when the empty state was detected the last time (in this example, this is the third time) exceeds the first threshold value.

Here, as shown with a line (b) in FIG. 5, when the empty state is detected the third time, when toner is refilled into the toner cartridge 25, it becomes possible to use a toner usage count which is, for example, of the same order as that of a new product, in other words, a count which is substantially greater than the first threshold value. Accordingly, in the step S16 shown in FIG. 4, it is judged that the amount of change b of the toner usage amount count from when the empty state was detected for the last time is greater than the first threshold value, so that it is determined that this toner cartridge 25 is a refilled product. As shown in FIG. 5, it is possible to determine that the cartridge is a refilled product at an earlier stage, than in the case that it is determined according to the new product reference threshold value (the second threshold value)

Since, in this embodiment, it is arranged to detect the empty state, and to determine that the subject cartridge is a refilled product based upon the amount of change of the toner usage amount count from the empty state, accordingly if the cartridge is refilled before the empty state occurs, it is not possible to make a determination as to whether this cartridge is a refilled product based upon the amount of change of the toner usage amount count from the empty state. However since, if the empty state has not occurred, it is arranged to make a determination in the step S18 of FIG. 4 as to whether or not the cumulative toner usage amount count exceeds the second threshold value, accordingly, as shown with line (c) in FIG. 5, if it is determined that the count does exceed the second threshold value, then it is possible to determine that the subject cartridge is a refilled product, in an appropriate manner. Accordingly, it is possible to make a determination as to whether or not even a toner cartridge 25 which was refilled before the empty state occurred is a refilled product.

Although the invention has been explained above based upon an embodiment thereof, the invention is not limited to this embodiment; it may be implemented in various other kinds of ways.

For example although, in the above embodiment, a common value was used for the first threshold value, irrespective of the number of times that the empty state has been detected for the same toner cartridge 25, the invention is not limited to this feature; for example, it would also be acceptable to arrange to decrease the threshold value, each time the empty state is detected for the same toner cartridge 25. By doing this, it becomes possible to determine that a cartridge is a refilled product at an earlier stage. It should be understood that, in this case, it would also be acceptable to arrange to store this threshold value in the non-volatile memory 26 of the toner cartridge 25, so as to decrease this threshold value each time the empty state is detected.

And although, in the above embodiment, it was arranged, if the empty state for the same toner cartridge 25 is detected a plurality of times, to make the determination that the cartridge is a refilled product based upon comparing together the amount of change of the toner usage amount count when the empty state was detected for the last time and a threshold value, the invention is not limited to this feature; for example, it would also be acceptable to arrange to make the determination that the cartridge is a refilled product based upon comparing together the amount of change of the toner usage amount count from when the empty state was detected for the first time and a threshold value.

And although, in the above embodiment, it was arranged to determine (estimate) whether or not the toner in the toner cartridge 25 is in the low state according to the toner density, the invention is not limited to this feature; for example, it would also be acceptable to arrange to provide an optical sensor which detects the presence or absence of toner in the toner cartridge 25, and to determine, based upon the result of detection by this optical sensor, whether or not the current cartridge state is one in which it is estimated that the toner is low.

And although, in the above embodiment, it was arranged to store the cumulative toner usage amount count when empty in the non-volatile memory 26, to obtain the amount of change of the toner usage amount count from when the empty state occurs by calculating the difference between the cumulative toner usage amount count and the cumulative toner usage amount count when empty, and to compare this with a threshold value, it would also be acceptable to, for example, arrange to accumulate the amount of change of the toner usage amount count from when the empty state occurs and to store it in the non-volatile memory 26, and to compare the amount of change of this toner usage amount count from when the empty state occurs with a threshold value; or, moreover, it would also be acceptable to store a threshold value cumulative toner usage amount count obtained by adding a threshold value to the cumulative toner usage amount count when the empty state occurs in the non-volatile memory 26, and subsequently to compare this threshold value cumulative toner usage amount count with the cumulative toner usage amount count; the point is to make a comparison between the amount of change of the toner usage amount count from when the empty state substantially occurs, and a threshold value.

What is claimed is:

1. An image forming device to which can be installed an image forming material cartridge which contains an image forming material, and which has a non-volatile memory from which data can be read and to which data can be written, comprising:

a counter which approximately counts the image forming material usage amount of the image forming material cartridge, and generates an image forming material usage amount count;

a state detector which detects a predetermined state in which it is inferred that the amount of the image forming material in the image forming material cartridge is low;

a storage unit which stores amount of change information which specifies the amount of change of the image forming material usage amount count from the time point that the predetermined state was detected until the present in the non-volatile memory of the image forming material cartridge; and a determination unit which determines that the image forming material cartridge is a refilled product when the amount of change of the image forming material usage amount count is larger than a first threshold value.

2. An image forming device according to claim 1, wherein the amount of change information includes a cumulative image forming material usage amount count, counted by the counter from the start of usage of the image forming material cartridge, and a cumulative image forming material usage amount count when detected, which is the cumulative image forming material usage amount count at the time point that the predetermined state is detected;

and further comprising a first judgement unit which obtains the amount of change of the image forming material usage amount count by subtracting the cumulative image forming material usage amount count when detected from the cumulative image forming material usage amount count, and judges whether or not the amount of change of the image forming material usage amount count is greater than the first threshold value; and wherein the determination unit determines that the image forming material cartridge is a refilled product, if it has been judged by the first judgement unit that the amount of change of the image forming material usage amount count is greater than the first threshold value.

3. An image forming device according to claim 2, wherein, when the predetermined state is detected for a second time, the storage unit updates the cumulative image forming material usage amount count when detected to the cumulative image forming material usage amount count at the time point of the detection for a second time.

4. An image forming device according to claim 3, wherein, when the predetermined state is detected for a second time, the first judgement unit changes the value of the first threshold value to a new value, and subsequently judges whether or not the amount of change of the image forming material usage amount count is greater than the first threshold value after change.

5. An image forming device according to claim 2, further comprising a second judgement unit which judges whether or not the cumulative image forming material usage amount count from the start of usage of the image forming material cartridge is greater than a second threshold value; and wherein the determination unit determines that the image forming material cartridge is a refilled product, if it has been judged by the second judgement unit that the cumulative image forming material usage amount count is greater than the second threshold value.

6. An image forming device according to claim 1, wherein refill desirability data which shows whether or not refilling of the image forming material cartridge is permitted is stored in the non-volatile memory, and further comprising:

a refill desirability judgement unit which, if it has been determined that the image forming material cartridge is a refilled product, judges whether or not refilling of the image forming material cartridge is permitted, based upon the refill desirability data in the non-volatile memory thereof; and an image forming possibility control unit which, if it has been determined that refilling of the image forming material cartridge is not permitted, makes image forming with the image forming material in the image forming material cartridge impossible.

7. An image forming device to which can be installed an image forming material cartridge which contains an image forming material, and which has a non-volatile memory from which data can be read and to which data can be written, wherein the non-volatile memory stores refill desirability data which shows whether or not the image forming material cartridge is classified as one for which refilling is permitted, comprising:

a refill desirability judgement unit which, if it has been determined that the image forming material cartridge is a refilled product, judges whether or not the image forming material cartridge is classified as one for which refilling is permitted, based upon the refill desirability data in the non-volatile memory thereof; and an image forming possibility control unit which, if it has been judged that the image forming material cartridge is not classified as one for which refilling is permitted, makes image forming with the image forming material in the image forming material cartridge impossible.

8. A refill determination method for an image forming device to which can be installed an image forming material cartridge which contains an image forming material, and which comprises a non-volatile memory from which data can be read and to which data can be written, comprising:

a counter of the image forming device approximately counting the image forming material usage amount of the image forming material cartridge, and generating an image forming material usage amount count;

a state detector of the image forming device detecting a predetermined state in which it is inferred that the amount of the image forming material in the image forming material cartridge is low;

a storage unit of the image forming device storing amount of change information which specifies the amount of change of the image forming material usage amount count from the time point that the predetermined state was detected until the present in the non-volatile memory of the image forming material cartridge; and a determination unit of the image forming device determining whether or not the image forming material cartridge is a refilled product, based upon the amount of change of the image forming material usage amount count and upon a first threshold value.

* * * * *